US010537766B2

(12) United States Patent
Cei et al.

(10) Patent No.: US 10,537,766 B2
(45) Date of Patent: Jan. 21, 2020

(54) CURVED MANUAL TREADMILL

(71) Applicant: TECHNOGYM S.P.A., Forli'-Cesena (IT)

(72) Inventors: Daniele Cei, Forli'-Cesena (IT); Guido Caperna, Forli'-Cesena (IT)

(73) Assignee: TECHNOGYM S.P.A., Forli'-Cesena (IT)

( * ) Notice: Subject to any disclaimer, the term of this patent is extended or adjusted under 35 U.S.C. 154(b) by 332 days.

(21) Appl. No.: 15/389,940

(22) Filed: Dec. 23, 2016

(65) Prior Publication Data

US 2017/0182356 A1 Jun. 29, 2017

(30) Foreign Application Priority Data

Dec. 29, 2015 (IT) ..... 102015000088497

(51) Int. Cl.

| | |
|---|---|
| ***A63B 22/02*** | (2006.01) |
| ***A63B 21/008*** | (2006.01) |
| ***A63B 21/012*** | (2006.01) |
| ***A63B 21/00*** | (2006.01) |
| ***A63B 22/00*** | (2006.01) |

(52) U.S. Cl.

CPC ..... *A63B 22/0285* (2013.01); *A63B 21/008* (2013.01); *A63B 21/012* (2013.01); *A63B 21/154* (2013.01); *A63B 22/0046* (2013.01)

(58) Field of Classification Search

CPC ... A63B 21/008; A63B 21/012; A63B 21/015; A63B 21/154; A63B 21/157; A63B 22/0017; A63B 22/0046; A63B 22/02; A63B 22/0207; A63B 22/0221;

(Continued)

(56) References Cited

U.S. PATENT DOCUMENTS 1,211,765 A * 1/1917 Schmidt ..... A63B 22/02 482/54
3,642,279 A * 2/1972 Cutter ..... A63B 22/02 482/54

(Continued)

FOREIGN PATENT DOCUMENTS

| | | | |
|---|---|---|---|
| JP | 2000140151 | A | 5/2000 |
| WO | 2009/014330 | A1 | 1/2009 |
| WO | 2014/160057 | A2 | 10/2014 |

OTHER PUBLICATIONS

Italian Written Opinion and Search Report dated Aug. 18, 2016 for ITUB20159481.

*Primary Examiner* — Joshua Lee

(74) *Attorney, Agent, or Firm* — Arent Fox LLP; Michael Fainberg

(57) ABSTRACT

A curved manual treadmill for the physical exercises of a user, comprising: a frame extending along a longitudinal direction; a first rotation shaft adapted to rotate around a respective first rotation axis transversal to the longitudinal direction of the frame; a second rotation shaft adapted to rotate around a respective second rotation axis transversal to the longitudinal direction of the frame; a physical exercise surface operatively connected to the first rotation shaft and to the second rotation shaft, so as to generate an endless closed physical exercise path, and a device for resisting the movement of the upper portion of the physical exercise surface operatively associated with at least either the first rotation shaft or the second rotation shaft.

12 Claims, 12 Drawing Sheets

(58) Field of Classification Search
CPC ..... A63B 22/0285; A63B 2022/0278; A63B 2022/206
See application file for complete search history.

(56) References Cited

U.S. PATENT DOCUMENTS

| | | | | | |
|---|---|---|---|---|---|
| 5,665,032 | A * | 9/1997 | Chen | A63B 22/0012 | 482/111 |
| 5,709,632 | A | 1/1998 | Socwell | | |
| 8,308,619 | B1 * | 11/2012 | Astilean | A63B 21/156 | 482/54 |
| 8,343,016 | B1 * | 1/2013 | Astilean | A63B 21/156 | 482/54 |
| 10,010,748 | B1 * | 7/2018 | Weinstein | A63B 22/0285 | |
| 2006/0287165 | A1 * | 12/2006 | Pasqualin | B62K 3/002 | 482/54 |
| 2012/0010048 | A1 * | 1/2012 | Bayerlein | A63B 21/0053 | 482/2 |
| 2014/0011642 | A1 * | 1/2014 | Astilean | A63B 22/02 | 482/54 |
| 2016/0367851 | A1 * | 12/2016 | Astilean | B62K 7/00 | |

* cited by examiner

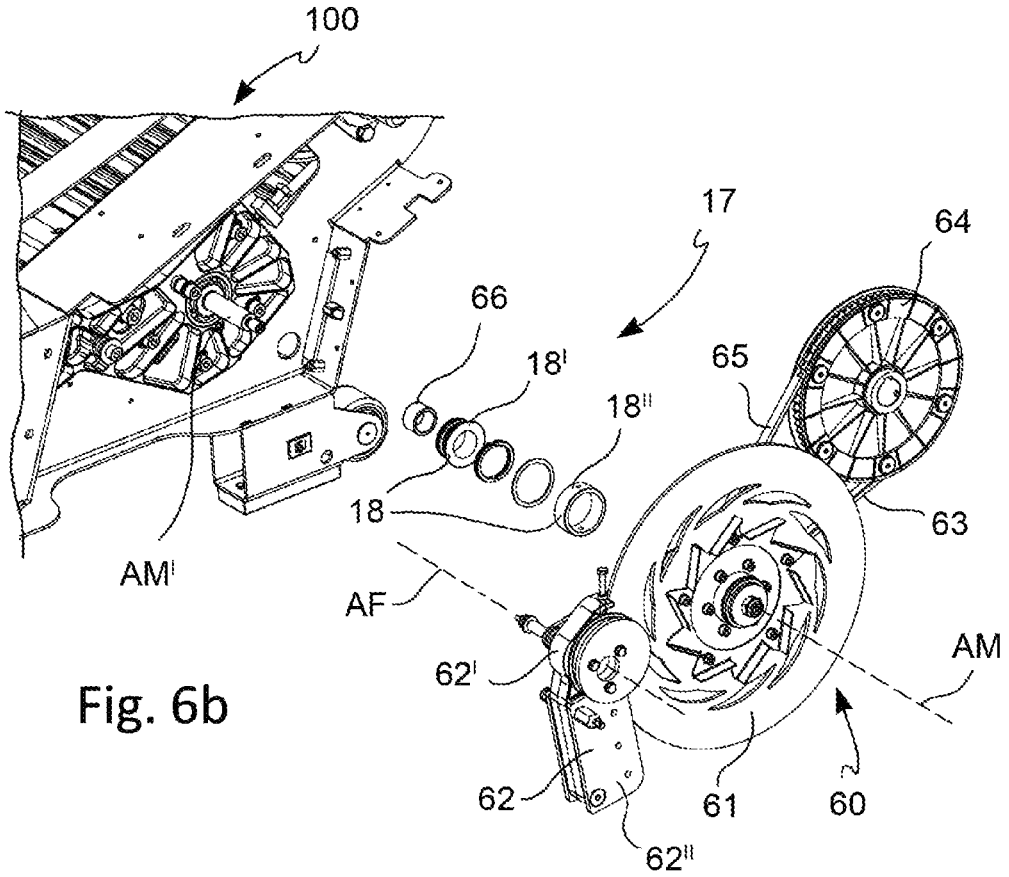
Fig. 6b
Fig. 6c
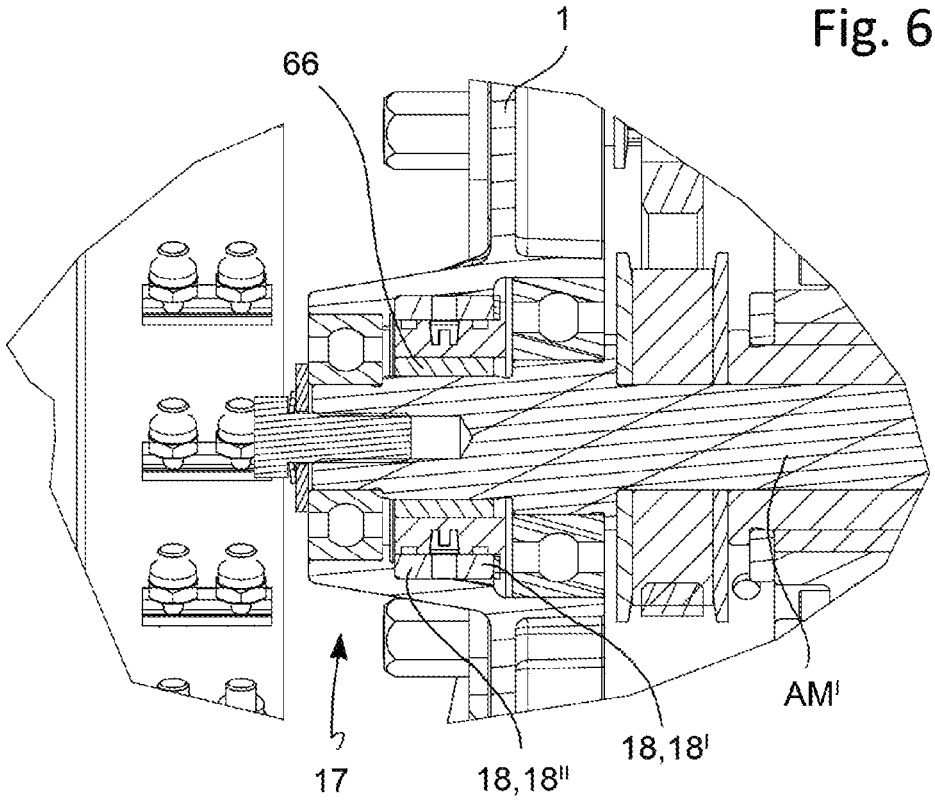

CURVED MANUAL TREADMILL

CROSS-REFERENCE TO RELATED APPLICATIONS

The present application claims priority to Italian Patent Application No. 102015000088497 filed Dec. 29, 2015, the entire contents of which are incorporated herein by reference.

FIELD OF THE INVENTION

The present invention relates to the sector of manual treadmills in general, and in particular to a curved manual treadmill.

BACKGROUND

As known, a "manual" treadmill is a motorless exercise machine which is manually actuated by the user by means of the interaction of the lower limbs with the walking/running belt.

A manual treadmill typically comprises a frame extending along a longitudinal direction of development parallel to the advancing direction of the user while walking or running.

Furthermore, such a manual treadmill comprises a first front rotation shaft and a second rear rotation shaft about which a walking/running belt is wound.

The walking/running belt of the user is typically mounted on the first front rotation shaft and on the second rear rotation shaft so as to have a curved side profile along, and respect to, the longitudinal direction of development of the frame on the part facing upwards, i.e. having a first descending portion starting from the first front rotation shaft and a second portion, opposite to the first portion, ascending towards the second rear rotation shaft.

While the user runs or walks on the walking/running belt, the weight force exerted by the user at the first descending portion of the walking/running belt allows to transform the potential energy into kinetic energy and to generate, accordingly, the rotation of the walking/running belt from the first front rotation shaft to the second rear rotation shaft by means of the interaction of the user's lower limbs with the walking/running belt alone.

The curved manual treadmill described above has the disadvantage of allowing the user to simply walk or run or, in all cases, perform a very limited number of physical exercises.

Nowadays, instead, the need is strongly felt to have exercise machines, and thus curved manual treadmills, which are as versatile as possible so as to allow a user to perform the largest possible number of mutually different, cardiovascular and muscle strength and strengthening physical exercises, even with a single exercise machine, and thus at low cost.

SUMMARY

It is the object of the present invention to devise and provide a curved manual treadmill which allows to at least partially avoid the drawbacks described above with reference to the prior art and which is, in particular, as versatile as possible so as to allow users to perform different types of physical activities employing the same exercise machine.

Such an object is achieved by a curved manual treadmill according to claim 1.

Preferred embodiments of said curved manual treadmill are defined in the dependent claims.

BRIEF DESCRIPTION OF THE DRAWINGS

Further features and advantages of the curved manual treadmill according to the invention will be apparent in the following description which illustrates preferred embodiments, given by way of indicative, non-limiting examples, with reference to the accompanying figures, in which:

FIG. 6*b* shows an enlarged view of the part exploded in FIG. 6*a;*

FIG. 6*c* shows an enlarged section view taken along plane CC in FIG. 6*a;*

DETAILED DESCRIPTION

Figure 1:
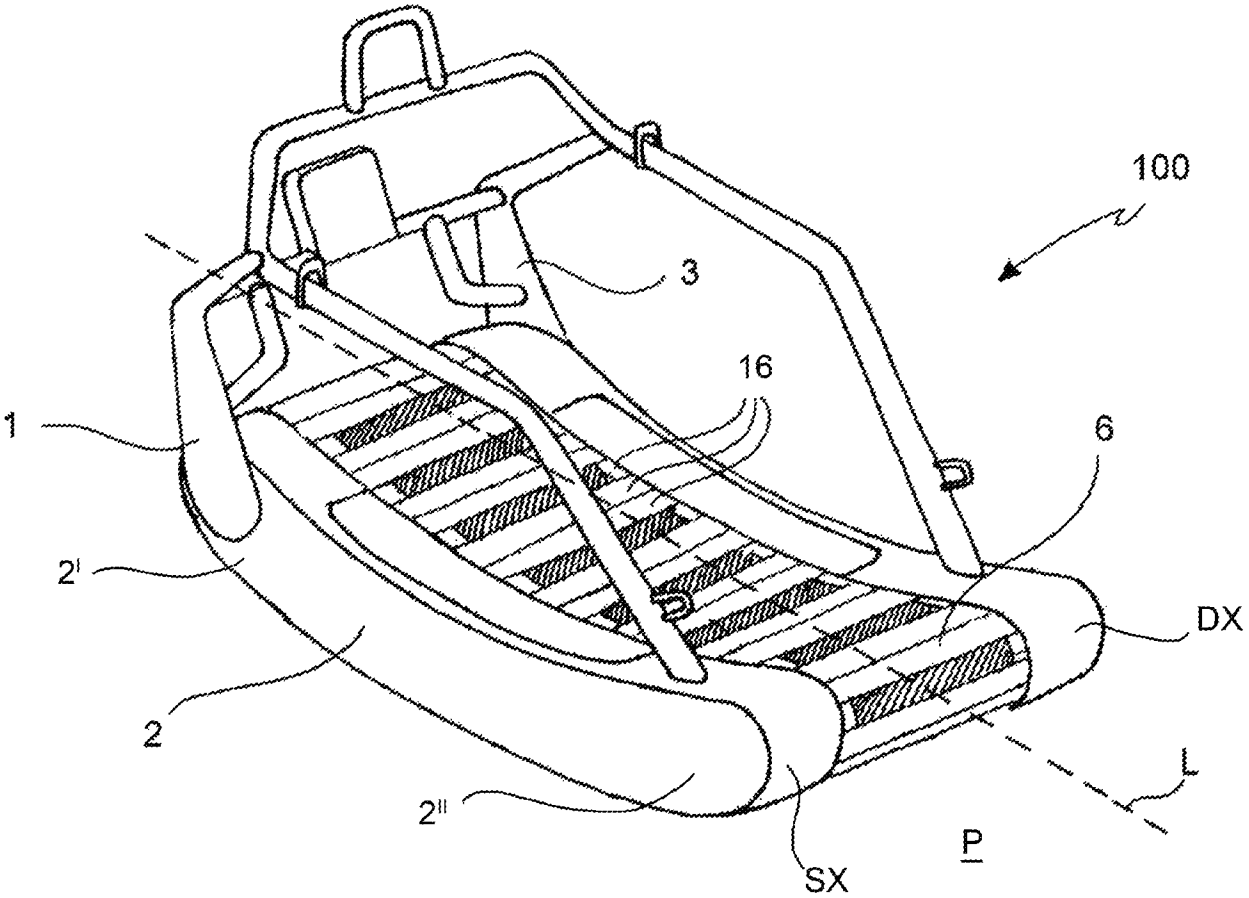
FIG. 1 diagrammatically shows a perspective view of a curved manual treadmill.

With reference to the aforesaid figures, reference numeral 100 indicates a curved manual treadmill, hereinafter also just curved treadmill or simply treadmill, for the physical exercises of a user, according to the invention as a whole.

It is worth noting that equal or similar elements in the figures will be indicated hereinafter with the same numeric or alphanumeric references.

As mentioned above, it is reminded that a "manual" treadmill is a motorless exercise machine which can be manually actuated by the user by means of the interaction of the lower limbs with the physical exercise surface, which will be introduced hereinafter, while exercising.

According to an embodiment, with particular reference to FIG. 1, the treadmill 100 comprises a frame 1 extending along a longitudinal direction L.

The longitudinal direction L is substantially parallel to a reference plane P representing the resting plane (e.g. a floor) of the treadmill 100.

The frame 1 comprises a base portion 2 distributed parallel to the reference plane P, having a front part 2' and a rear part 2", opposite to the front part 2'.

The base portion 2 further comprises a first left side part SX extending along the longitudinal direction L from the front part 2' to the rear part 2" and a second right side part DX extending along the longitudinal direction L from the front part 2' to the rear part 2".

The frame 1 further comprises a support portion 3 extending substantially in vertical direction with respect to the reference plane P starting from the base portion 2.

The support portion 3 is e.g. a combination of uprights and tubular elements operatively connected to one another and distributed so as to define a support structure for the user while employing the treadmill 100.

In particular, as shown in FIG. 1, the support structure defined by the support portion 3 is distributed in the front part 2' (as shown in FIG. 1) and/or in the first left side part SX (partially shown in FIG. 1) and/or in the second right side part DX (partially shown in FIG. 1) and/or in the rear part of the base portion 2 (not shown in FIG. 1).

Figure 2:
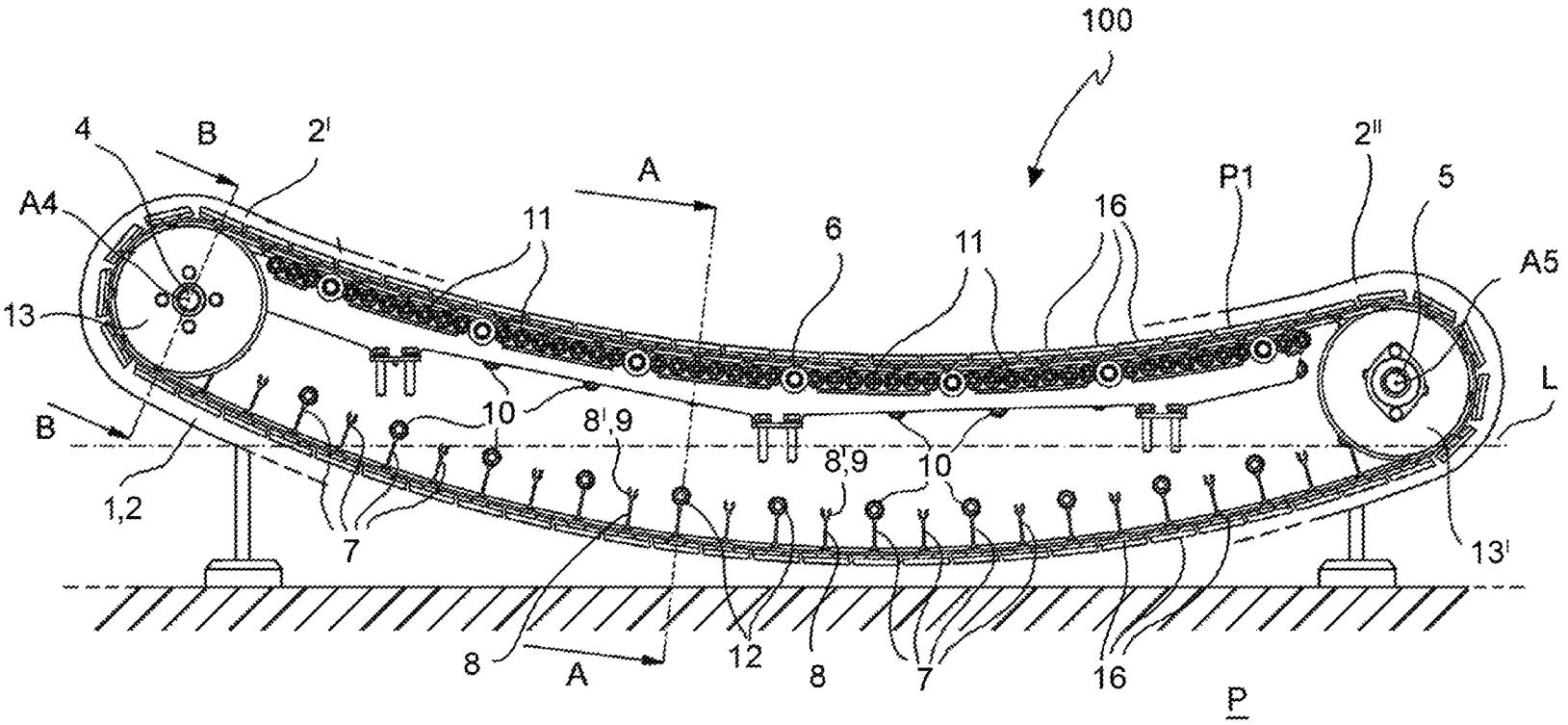
FIG. 2 diagrammatically shows a side section view of a portion of the curved manual treadmill shown in FIG. 1.

Turning now to FIG. 2, the treadmill 100 further comprises a first rotation shaft 4 adapted to rotate about a respective first rotation axis A4 transversal to the longitudinal direction L of the frame 1.

The first rotation shaft 4 is arranged in the front part 2' of the base portion 2.

Furthermore, the frame 1 comprises a second rotation shaft 5 adapted to rotate about a respective second rotation axis A5 transversal to the longitudinal direction L of the frame 1. The second rotation shaft 5 is arranged in the rear part 2" of the base portion 2.

The second rotation axis A5 is parallel to the first rotation axis A4.

The frame 1 further comprises a physical exercise surface 6 operatively connected to the first rotation shaft 4 and to the second rotation shaft 5, so as to generate an endless closed exercise path P1.

For the purposes of the present description, it is worth noting that physical exercises of a user means any physical exercise which can be performed by the user by placing their feet, or lower limbs in general, on the physical exercise surface, such as, for example, running, walking, pulling exercises or any other physical cardiovascular training and/or muscle-strengthening exercise which can be performed employing a curved manual treadmill.

With this regard, as clearly seen in FIG. 2, the upper portion of the physical exercise path P1 (the one adapted to interact with the user, not shown in the figures) has a set curved side profile along the longitudinal direction L of the frame 1 so that a force generated by the user on the physical exercise surface 6 generates the rotation of the first rotation shaft 4 and of the second rotation shaft 5 causing the movement of the physical exercise surface 6 either along a first advancing direction from the first rotation shaft 4 to the second rotation shaft 5, and thus from the front part 2' to the rear part 2" of the base portion 2, or along a second advancing direction from the second rotation shaft 5 to the first rotation shaft 4, i.e. from the rear part 2" to the front part 2' of the base portion 2.

This is obviously as a function of the direction of the action performed by the user on the physical exercise surface 6.

It is worth noting that the first advancing direction is the one in which the treadmill 100 is employed for performing the most classical physical exercises (e.g. walking/running) and for most of the other physical exercises.

The second advancing direction is instead the one in which the treadmill 100 is used to perform other physical exercises.

Figure 3:
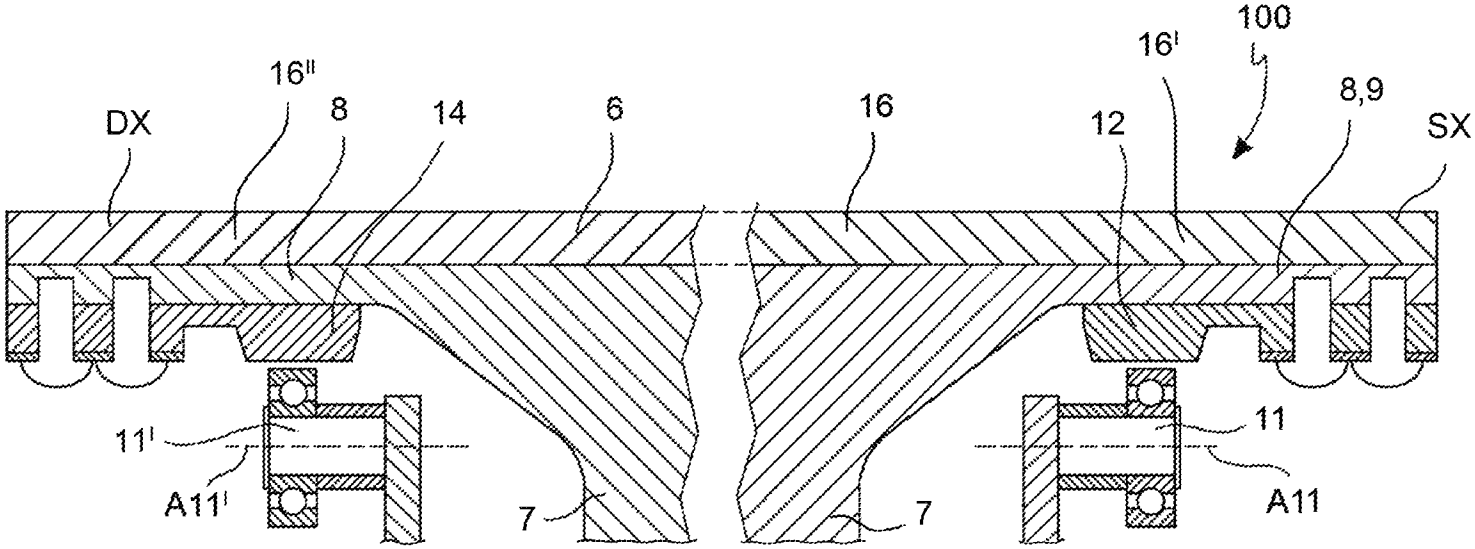
FIG. 3 diagrammatically shows a section view taken along plane AA in FIG. 2 of a portion of the curved manual treadmill shown in FIG. 1.
Figure 4:
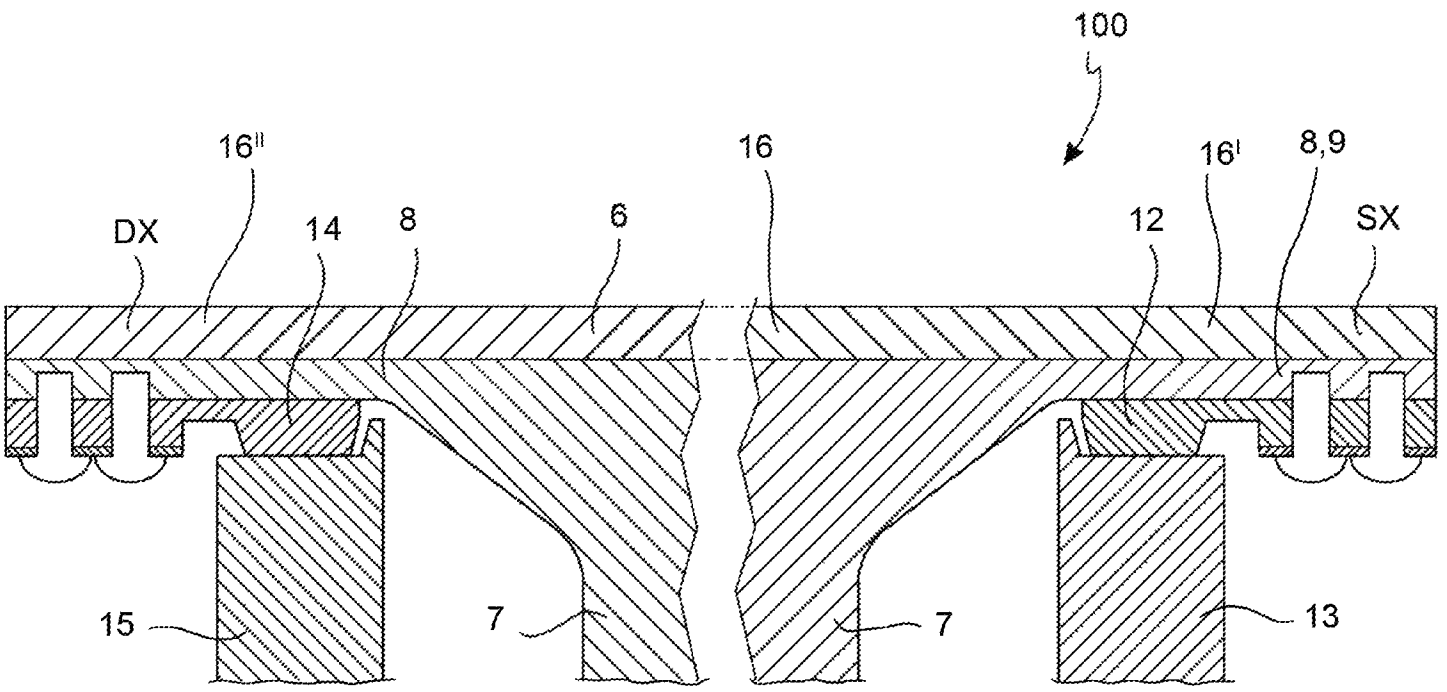
FIG. 4 diagrammatically shows a section view taken along plane BB in FIG. 2 of a further portion of the curved manual treadmill shown in FIG. 1.

According to an embodiment, shown in FIGS. 2, 3 and 4, the physical exercise surface 6 comprises a plurality of walls 7 extending from the inner surface of the physical exercise surface 6.

In more detail, each wall 7 of the plurality of walls 7 has a proximal portion 8 associated with the second inner surface of the physical exercise surface 6 (shown in FIGS. 3 and 4) and a distal portion 8' (shown in FIG. 2), opposite to the proximal portion 8, having a first side end and a second side end, opposite to the first side end, only the latter of which is seen in FIG. 2 and indicated by numerical reference 9.

According to an embodiment, shown in the figures, a first plurality of rotatable elements 10 (e.g. rolls or bearings) is distributed on at least one part of said plurality of walls 7 so that a first rotatable element 8 and a second rotatable element are coupled in a freely rotatable manner about a respective rotation axis to the first side end 9 and to the second side end of a respective wall of said at least one part of said plurality of walls 7, respectively.

It is worth noting that in the embodiment in FIG. 2, the first plurality of rotatable elements 10 is distributed alternatively on one wall but not on the other.

According to another embodiment, not shown in the figures, the first plurality of rotatable elements 10 may be distributed on each wall of the plurality of walls 7.

Again with reference to the embodiment shown in FIG. 2, the frame 1 comprises constraint elements (not shown in the figures) of the physical exercise surface 6 of the frame 1 adapted to cooperate with the first plurality of rotatable elements 10 of the physical exercise surface 6 along at least the upper portion of the physical exercise path P1 generated by the physical exercise surface 6.

In more detail, such constraint elements are shaped so as to keep the curved side profile of the upper portion P1 of the physical exercise path P1 generated by the physical exercise surface 6 substantially equal to the set curved side profile of the upper portion of the physical exercise path P1.

The constraint elements comprise a first wall distributed within the first left side part SX of the base portion 2 also extending along the longitudinal direction L from the front part 2' to the rear part 2" and a second part distributed within the second right side part DX also extending along the longitudinal direction L from the front part 2' to the rear part 2".

Both the first wall and the second wall are shaped so that the first plurality of rotatable elements 10 abuts against the constraint elements to prevent the movement of the upper portion of the physical exercise path P1 generated by the physical exercise surface 6 along a direction substantially orthogonal to a plane which is tangent, point-by-point, to the set curved side profile of the upper portion of the physical exercise path P1, consequently preventing the upper portion of the physical exercise path P1 from assuming a side profile different from the set curved side profile.

According to another embodiment, alternative to the one shown in the figures, the base portion 2 of the frame 1 of the treadmill 100 may comprise respective side guides closed on the entire curved side profile of the physical exercise surface 6 in order to keep the curved side profile of the upper portion of the physical exercise path P1 with respect to the longitudinal direction of development of the base portion 2 as much as possible.

In this embodiment, on both sides, the physical exercise surface 6 comprises elements which are freely rotatable about a respective axis (e.g. rolls or bearings) inserted and adapted to roll within the side guides of the base portion 2 of the frame 1.

According to another embodiment, not shown in the figures, alternatively to those described above, the base portion 2 of the frame 1 of the treadmill 100 comprises a synchronization belt associated with the first rotation shaft 4 and with the second rotation shaft 5 either in the left side part SX of the base portion 2 or in the right side part DX of the base portion.

The synchronization belt is adapted to ensure the synchronized rotation of the first rotation shaft 4 and of the second rotation shaft 5 during the rotation of the physical exercise surface, while maintaining the curved side profile of the upper portion of the physical exercise path P1 generated by the physical exercise surface 6.

With reference to FIGS. 2 and 4, according to a further embodiment, in combination with any one of the embodiments described above, the treadmill 100 further comprises support elements 11, 11' of the physical exercise surface 6.

The support elements 11, 11' comprise a first plurality of rotatable elements 11 distributed within the first left side part SX of the base portion 2, also extending along the longitudinal direction L from the front part 2' to the rear part 2", and a second plurality of rotatable elements 11' distributed within the second right side part DX, also extending along the longitudinal direction L from the front part 2' to the rear part 2".

Each rotatable element of the first plurality of rotatable elements 11 and of the second plurality of rotatable elements 11' is associated with the frame 1 so as to be freely rotatable about a respective rotation axis A11, A11', transversal to the longitudinal direction L of the frame 1. With this regard, each rotatable element is, for example, a roll or a bearing (as shown in FIGS. 2 and 3).

It is worth noting that the first plurality of rotatable elements 11 and the second plurality of rotatable elements 11' are distributed along the longitudinal direction L of the frame 1 according to a trajectory corresponding to the set curved side profile.

In such a distribution, the first plurality of rotatable elements 11 and the second plurality of rotatable elements 11' are adapted to prevent the movement of the upper portion of the physical exercise path P1 along a first direction substantially orthogonal to a plane which is tangent, point-by-point, to the set curved side profile of the upper portion of the physical exercise path P1.

Thus, it is worth noting that also this arrangement of the support elements 11, 11' of the physical exercise surface 6 contributes to preventing the upper portion of the physical exercise path P1 generated by the physical exercise surface 6 from assuming a side profile which is different from the set curved side profile.

In more detail, with reference again to the embodiment shown in FIGS. 2 and 3, the proximal portion 8' of each wall of said plurality of walls 7 extending from the physical exercise surface 6 is adapted to abut against the plurality of rotatable elements 11, 11' of the support elements 11, 11', associated with the frame 1, of the physical exercise surface 6 to the frame 1.

In particular, according to a further embodiment shown in FIGS. 3 and 4, the proximal portion 8 of each wall of said plurality of walls 7 extending from the inner surface of the physical exercise surface 6 comprises a first flexible motion transmission element 12 adapted to abut against the first plurality of rotatable elements 11.

Furthermore, with reference to FIG. 4, the first flexible motion transmission element 12, outside the first plurality of rotatable elements 11, is adapted to abut against a respective first pulley 13, operatively associated with the first rotation shaft 4, adapted to rotate about the first rotation axis A4 (not shown in FIG. 4).

With reference again to the embodiment shown in FIGS. 3 and 4, the proximal portion 8 of each wall of said plurality of walls 7 extending starting from the inner surface of the physical exercise surface 6 further comprises a second flexible motion transmission element 14 adapted to abut against the second plurality of rotatable elements 11'.

Furthermore, as shown again in FIG. 4, the second flexible motion transmission element 14, outside the second plurality of rotatable elements 11', is adapted to abut against a respective second pulley 15, operatively associated with the first rotation shaft 4, adapted to rotate about the second rotation axis A4.

The first pulley 13 and the second pulley 15 are fixed to the first rotation shaft 4.

It is worth noting that both the first flexible motion transmission element 12 and the second flexible motion transmission element 14 are, for example, transmission belts adapted to define a respective closed path corresponding to the physical exercise path P1 generated by the physical exercise surface 6.

It is worth noting that the first flexible motion transmission element 12 is wound about the first pulley 13 and a further pulley 13' (FIG. 2) fixed to the second rotation shaft A5 so as to transmit the rotation from the first rotation shaft A4 to the second rotation shaft A5 or vice versa.

Similarly, the second flexible motion transmission element 14 is wound about the second pulley 15 and about a further pulley (not seen in the figures) fixed to the second rotation shaft A5 so as to transmit the rotation of the first rotation shaft A4 to the second rotation shaft A5, and vice versa.

Turning back to an embodiment shown in the figures in general, in combination with any one of the other embodiments described above, the physical exercise surface 6 comprises a plurality of slats 16 placed mutually side-by-side, each having a longitudinal direction of development which is transversal with respect to the longitudinal direction L of the frame 1.

In more detail, each slat 16 of the plurality of slats 16 comprises a first end 16' and a second end 16", opposite to said first end 16'.

As shown in FIG. 4, the first end 16 of each slat 16 is secured, e.g. by means of screws (shown in the figure), to the first flexible motion transmission element 12, operatively associated with the first rotation shaft 4 and with the second rotation shaft 5 so as to define the endless closed physical exercise path P1 of the physical exercise surface 6.

The second end 16" of each slat 16 is secured, e.g. by means of screws (shown in the figure), to the second flexible motion transmission element 14 operatively associated with the first rotation shaft 4 and the second rotation shaft 5 so as to define the endless closed exercise path P1 of the physical exercise surface 6.

It is worth noting that, according to an embodiment in the figures, e.g. shown in FIG. 2, each wall 7 of said plurality of walls 7 is associated with a respective slat 16 of said plurality of slats 16.

According to a further embodiment (not shown in the figures), the physical exercise surface 6 may be in one piece, e.g. made of flexible plastic material.

Figure 6A:
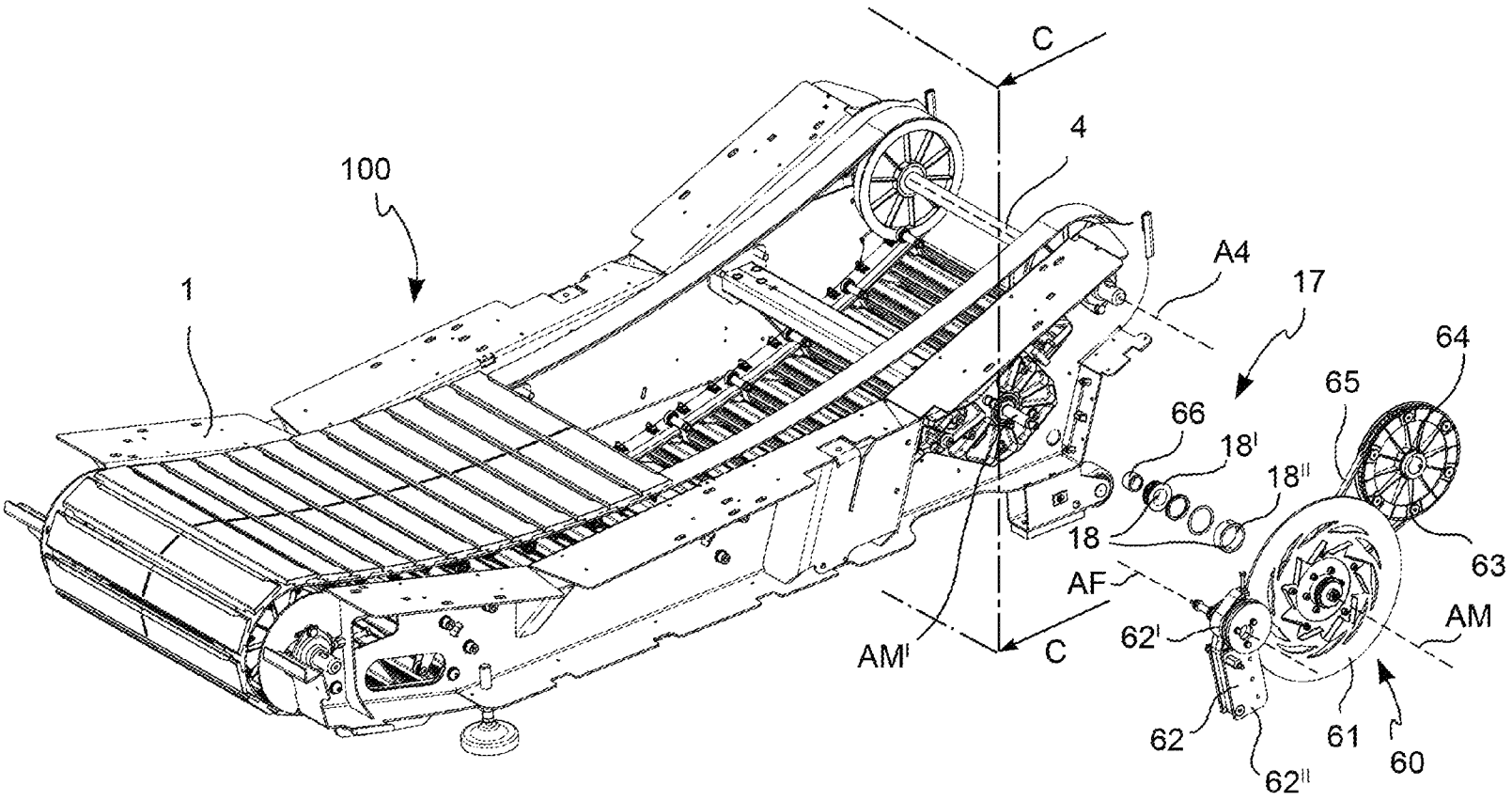
FIG. 6*a* shows a perspective view of a portion with an exploded part of the curved manual treadmill according to an embodiment of the invention.

With reference to FIGS. 6*a* and 6*b*, according to an embodiment, either in combination with or alternatively to any one of the embodiments described above, the treadmill 100 further comprises a brake device 60 operatively associated with either the first rotation shaft 4 or the second rotation shaft.

In the embodiment in FIGS. 6*a* and 6*b*, the brake device 60 is operatively connected to the first rotation shaft 4.

In an alternative embodiment (not shown in the figures), the brake device 60 could be operatively connected to the second rotation shaft 5.

Turning back to the embodiment shown in FIGS. 6*a* and 6*b*, the brake device 60 comprises at least one metal disc 61 (e.g. made of copper or aluminum) adapted to rotate about a respective rotation axis AM, which is parallel to the rotation axis A4 of the first rotation shaft 4.

Furthermore, the brake device 60 comprises an actuation bracket 62 having at least one magnet.

The actuation bracket 62 is shaped to exert a braking action on the metal disc 61 due to the magnetic effect following the interaction of said at least one magnet with the metal disc 61.

In more detail, the actuation bracket 62 comprises a first end 62' operatively coupled to the frame 1 and a second end 62", opposite to the first free end 62'.

In particular, the first end 62' is adapted to rotate freely about a respective rotation axis AF.

Said at least one magnet is operatively associated with the second end 62".

It is worth noting that the actuation bracket 62 can be actuated by the user by means of a command or lever (not shown in the figures) preferably associated with the support portion 3 of the frame 1, easily accessible by the user also while exercising.

It is worth noting that the actuation of the command or lever by the user is adapted to cause the rotation of the actuation lever 62 about the rotation axis AF of the first end 62', the movement of the second end 62", and thus the movement of at least one magnet, with respect to the metal disc 61. Naturally, the braking action determined by the user will vary according to the position assumed by said at least one magnet with respect to the metal disc 61, i.e. to the level of overlap of said at least one magnet with respect to the metal disc 61. It is worth noting that there will be no braking action if there is no overlapping between said at least one magnet and the metal disc 61.

Turning back to the brake device 60 in FIGS. 6*a* and 6*b*, it is worth noting that the metal disc 61 and the actuation bracket 62 are operatively connected to the frame 1.

Furthermore, the metal disc 61 is operatively connected to the first rotation shaft 4 by means of a belt-pulley mechanism 63 with which the treadmill 100 is equipped.

In more detail, the belt-pulley mechanism 63 comprises a first pulley 64 and a second pulley (not seen in the figures).

The first pulley 64 is integral with the first rotation shaft 4.

The second pulley is coupled to the frame 1 so as to be freely rotatable about the rotation axis AM of the magnetic disc 61.

In more detail, the second pulley is integral with a respective rotation axis adapted to rotate about the rotation axis AM of the magnetic disc 61.

Indeed, the metal disc 61 is operatively associated with the rotation shaft of the second pulley so as to rotate about the respective rotation axis AM.

The belt-pulley mechanism 63 further comprises a motion transmission belt 65 operatively connected to the first pulley 64 and to the second pulley.

In an embodiment, the belt-pulley mechanism 63 further comprises an auxiliary wheel (not shown in the figures), adapted to rotate freely about a corresponding rotation axis operatively associated with the frame 1, so that the motion transmission belt 65 is constrained between the second pulley and the auxiliary wheel.

This particular configuration allows the motion transmission belt 65 to keep the correct position during motion transmission, avoiding the use of additional tensioning elements of the motion transmission belt 65, thus obtaining a reduction of the friction and an increase of efficiency of the brake device 60.

According to an embodiment, shown in the figures, the metal disc 71 of the brake device 60 is operatively connected to the frame 1 by means of a respective rotation shaft AM' with which the frame 1 is equipped.

The brake device 60 is operatively coupled to the respective rotation shaft AM' by means of a respective coupling device 66.

The coupling device 66 of the brake device 60 is, for example, a free-wheel type mechanism.

If the rotation speed of the first rotation shaft 4 is slower than the rotation speed of the metal disc 61, the coupling device 66 of the brake device 60 is adapted to prevent the transmission of the inertia of the magnetic disc 61 to the physical exercise surface 6, thus preventing drawbacks for the user.

Turning back in general to the treadmill 100 of the present invention, with reference to any one of the embodiments shown in FIGS. 5*a*-5*c*, 6*a*-6*c*, 7*a*-7*b*, 8*a*-8*d*, either alternatively to or in combination with those described above, the treadmill 100 comprises a device 17 for resisting the movement of the upper portion of the closed physical exercise path P1 of the physical exercise surface 6 operatively associated with either the first rotation shaft 4 or the second rotation shaft 5 of the base portion 2.

It is worth noting that the movement resistance device 17 is adapted to generate a resistance of any type to the movement of the upper portion of the physical exercise path P1 of the physical exercise surface 6, such as resistance, friction, contrast, constraint and so on.

The resistance device 17 is advantageously configured to oppose the rotation of either the first rotation shaft 4 or the second rotation shaft 5 in the second advancing direction of the physical exercise surface 6 and to not oppose the rotation of either the first rotation shaft 4 or the second rotation shaft 5 in the first advancing direction of the physical exercise surface 6.

It is worth noting that in the first direction of advancement, the possible deceleration of the physical exercise surface 6 can be obtained by using a brake device with which the treadmill 100 may be equipped.

Figure 5A:
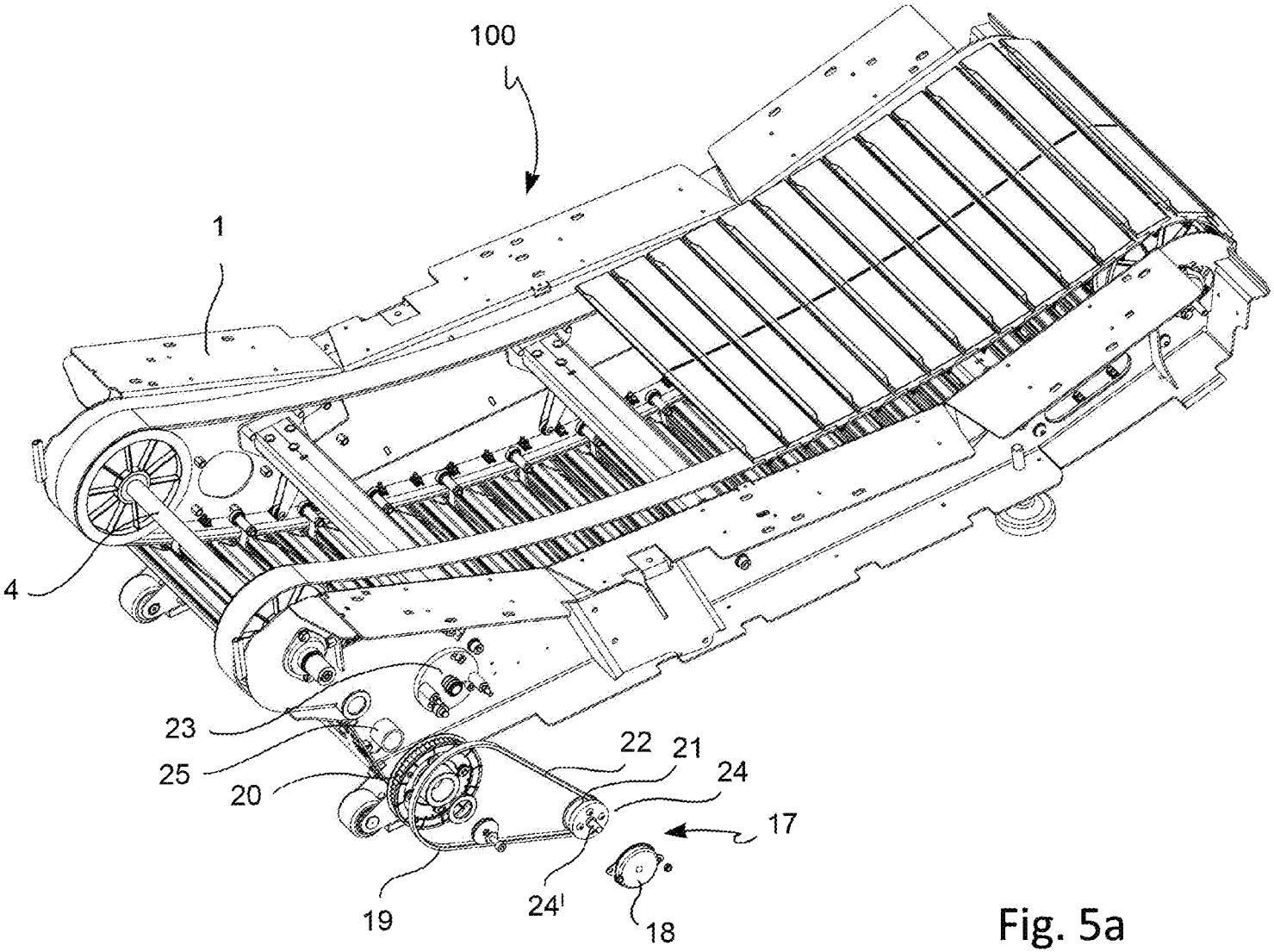
FIG. 5*a* shows a perspective view of a portion with an exploded part of a curved manual treadmill according to an embodiment of the invention.
Figure 5B:
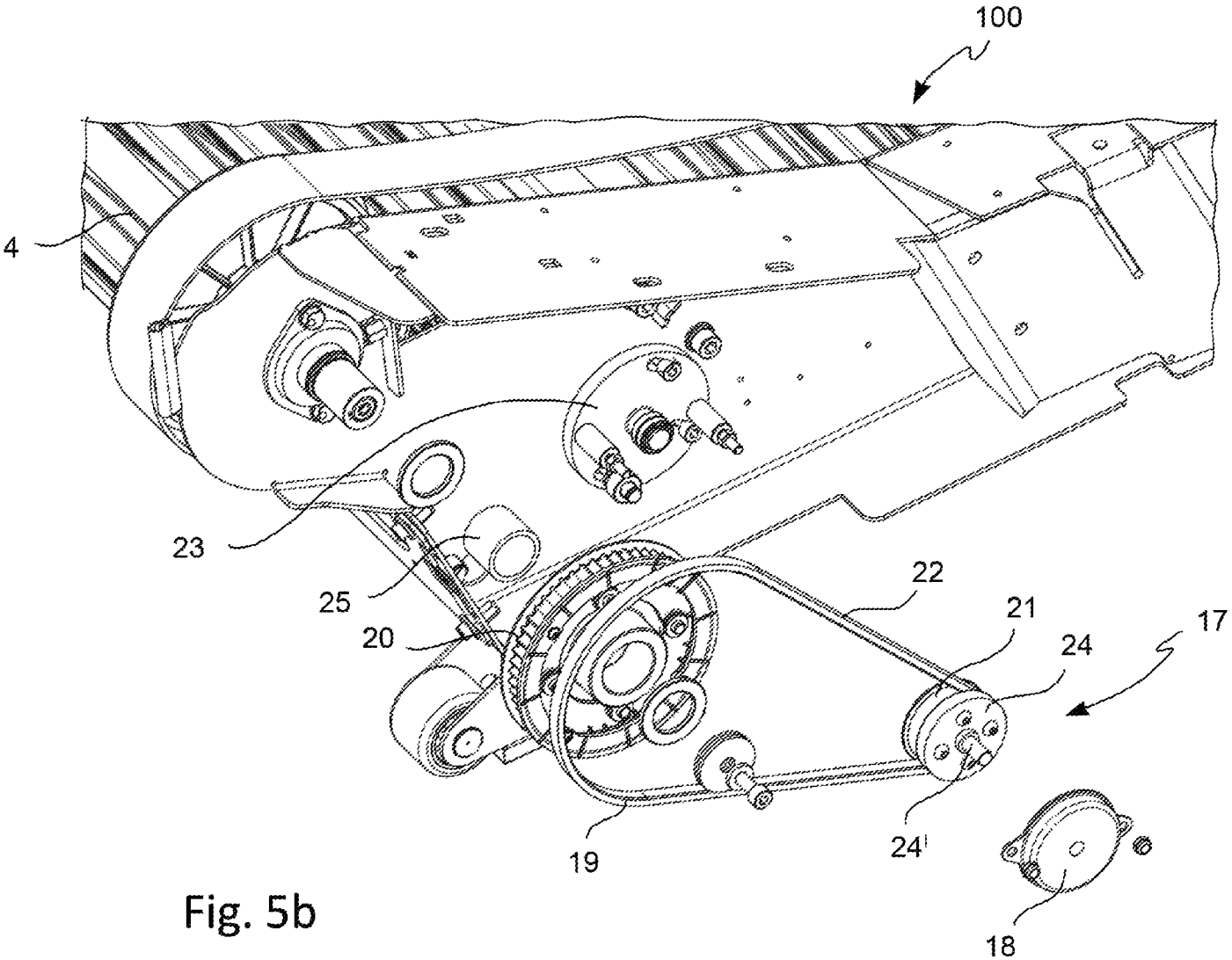
FIG. 5*b* shows an enlarged view of the exploded part of FIG. 5*a;*

With reference to FIGS. 5*a* and 5*b*, according to an embodiment, the resistance device 17 comprises a damping element 18, operatively connected to either first rotation shaft 4 or the second rotation shaft 5 by means of a respective belt-pulley mechanism 19 with which the treadmill 100 is equipped.

In the embodiment shown in FIGS. 5*a* and 5*b*, the damping element 18 is operatively connected to the first rotation shaft 4.

It is worth noting that in this embodiment, the resistance device 17 is arranged on a rotation axis which is separate from the rotation axis of the rotation shaft on which the resistance is generated.

In more detail, the belt-pulley mechanism 19 comprises a first pulley 20 (for primary transmission), a second pulley 21 (for secondary transmission) and a motion transmission belt 22 operatively connected to the first pulley 20 and to the second pulley 21.

The first pulley 20 is integral with the first rotation shaft 4 of the treadmill 100.

The second pulley 21 is coupled to the frame 1 of the treadmill 100 by means of a first bracket 23 fixed to the frame 1, e.g. by means of screws.

The second pulley 21 is freely rotatable about a respective rotation axis.

The damping element 18 comprises an inner part (not seen in the figures) and an outer part that are coaxial to each other, inside which the inner part is housed.

The outer part is disc-shaped, for example, while the inner part is preferably ring-shaped.

The inner part and the outer part of the damping element 18 are axially coupled to each other and are free to rotate reciprocally with respect to each other.

The space between the inner part and the outer part of the damping element 18 is adapted to house a viscous fluid, suitable for generating a viscous resistance between the outer part and the inner part of the damping element 18 during the mutual rotation thereof.

The outer part is fixed to the frame 1 of the treadmill 100, e.g. by means of screws, and represents the fixed part of the damping element 18.

The inner part is adapted to rotate within the outer part about a respective rotation axis and represents the mobile part of the damping element.

The inner part of the damping element is operatively connected to the second pulley 21 by means of a second bracket 24 fixed, for example, by means of screws, to the second pulley 21.

The second bracket 24 comprises a respective rotation shaft 24' integral with the second pulley 21, which is, in turn, integral with the inner part of the damping element 18 so that the rotation of the second pulley 21 causes the generation, by the damping element 18, of a viscous resistance which opposes the rotation of the second pulley 21.

The resistance device 17 further comprises a respective coupling device 25.

The first pulley 20 is associated with the rotation shaft 4 by means of the coupling device 25 of the resistance device 17.

The coupling device 25 is, for example, a free-wheel type mechanism.

According to an embodiment, the coupling device 25 is adapted to make the first pulley 20 and either the first rotation shaft 4 or the second rotation shaft 5 (the first rotation shaft 4, in the example shown in the figures) freely rotatable when the first rotation shaft 4 of the frame 1 rotates to move the upper portion P1 of the physical exercise surface 6 along the first advancing direction from the first rotation shaft 4 to the second rotation shaft 5 and to make the first pulley 20 and either the first rotation shaft 4 or the second rotation shaft 5 integral when the first rotation shaft 4 of the frame 1 rotates in the opposite direction to move the upper portion P1 of the physical exercise surface 6 along the second advancing direction from the second rotation shaft 5 to the first rotation shaft 4.

Therefore, in the first advancing direction, the coupling device 25 is adapted to prevent the action of the damping element 18, while in the second advancing direction the coupling device 25 is adapted to allow the action of the damping element 18.

Indeed, it is worth noting that the rotation of the first pulley 20 generates the rotation of the second pulley 21 by means of the motion transmission belt 22.

The rotation of the second pulley 21 results, in turn, in the rotation of the inner (mobile) part of the damping element 18 with respect to its outer part, resulting in the generation of a viscous resistance along the second advancing direction of the upper portion of the closed physical exercise path P1 of the physical exercise surface 6.

According to a further embodiment, either alternatively to or in combination with the one above, the coupling device 25 of the resistance device 17 could be configured to allow the action of the damping element 18 also in the first advancing direction of the physical exercise surface 6.

Turning now to FIGS. 6*a* and 6*b*, according to a further embodiment, alternative to the ones described with reference to FIGS. 5*a* and 5*b*, the resistance device 17 comprises a damping element 18 arranged on the rotation shaft AM' on which the brake disc 61 of the brake device 60, described above, is fitted.

It is worth noting that, in this embodiment, the resistance device 17 is arranged on a rotation axis of the rotation shaft on which to generate the resistance (rotation shaft AM'), which is parallel to the first rotation shaft 4.

In more detail, the damping element 18 comprises an inner ring 18' and an outer ring 18" that are coaxial to each other, inside which the inner ring 18' is housed.

The inner ring 18' and the outer ring 18" are axially coupled to each other and are free to rotate reciprocally with respect to each other.

The space between the inner ring 18' and the outer ring 18" of the damping element 18 is adapted to house a viscous fluid, suitable for generating a viscous resistance between the outer ring 18" and the inner ring 18' of the damping element 18 during the mutual rotation thereof.

The outer ring is fixed to the frame 1 of the treadmill 100, e.g. by means of screws, and represents the fixed part of the damping element 18.

The inner ring 18' is adapted to rotate within the outer ring 18" about a respective rotation axis and represents the mobile part of the damping element 18.

The inner ring 18' of the damping element 18 is operatively connected to the rotation shaft AM' on which the brake disc 61 of the brake device 60 is fixed by means of the coupling device 66 with which the brake device 60 is equipped, adapted to connect the brake disc 61 to the respective rotation shaft AM'.

According to an embodiment, the coupling device 66 is adapted to make the rotation shaft AM' and the inner ring 18' of the damping element 18 freely rotatable when the first rotation shaft 4 of the frame 1 rotates to move the upper portion P1 of the physical exercise surface 6 along the first advancing direction from the first rotation shaft 4 to the second rotation shaft 5 and to make the rotation shaft AM' and the inner ring 18' of the damping element 18 integral when the first rotation shaft 4 of the frame 1 rotates in the opposite direction to move the upper portion P1 of the physical exercise surface 6 along the second advancing direction from the second rotation shaft 5 to the first rotation shaft 4.

Therefore, in the first advancing direction, the coupling device 66 is adapted to prevent the action of the damping element 18, while in the second advancing direction the coupling device 66 is adapted to allow the action of the damping element 18.

Indeed, the rotation of the damping element 18 (i.e. the rotation of the inner ring 18' with respect to the outer ring 18") results in the generation of a viscous resistance along the second advancing direction of the upper portion of the closed physical exercise path P1 of the physical exercise surface 6.

According to a further embodiment, either alternatively to or in combination with the one above, the coupling device 66 of the resistance device 17 could be configured to allow the action of the damping element 18 also in the first advancing direction of the physical exercise surface 6.

Figure 7A:
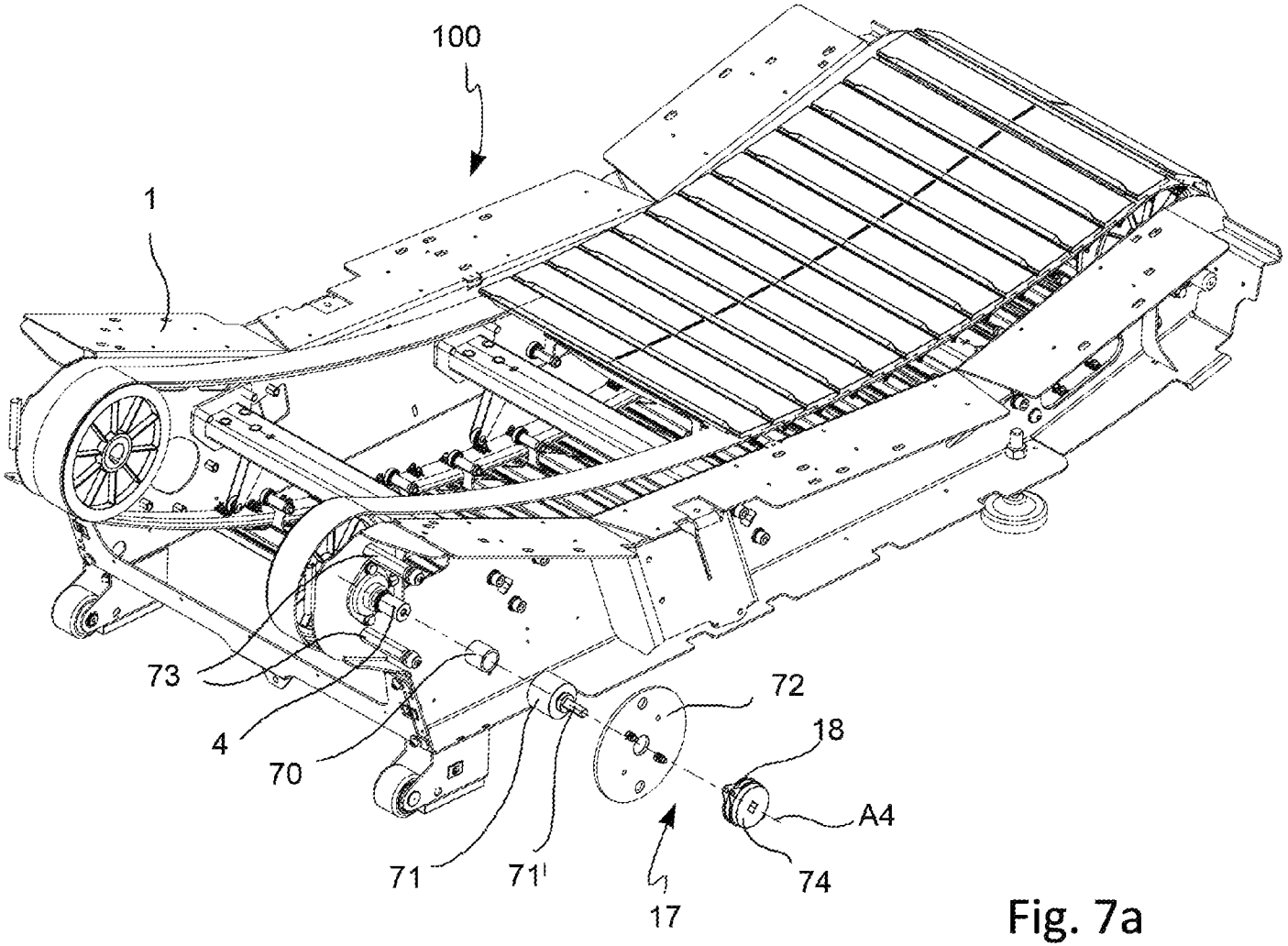
FIG. 7*a* shows a perspective view of a portion with an exploded part of the curved manual treadmill according to an embodiment of the invention.
Figure 7B:
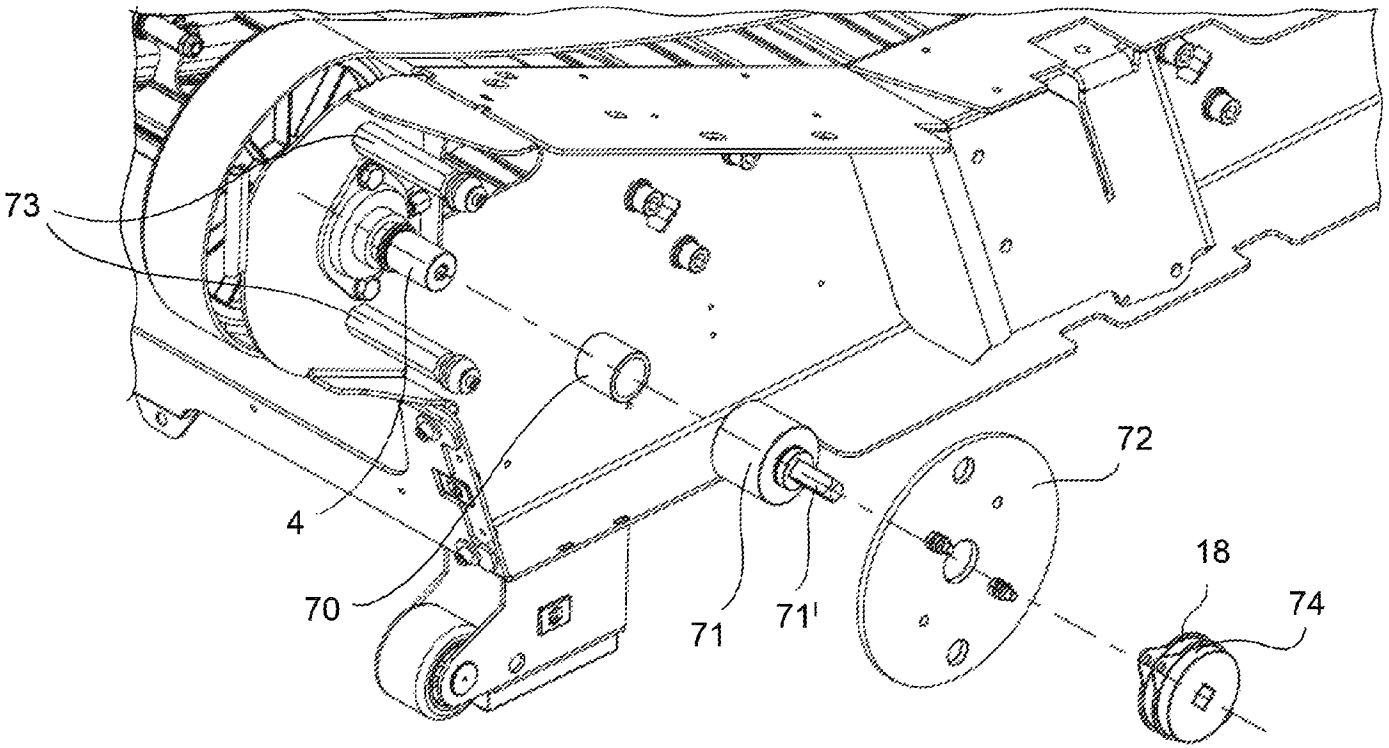
FIG. 7*b* shows an enlarged view of the exploded part of FIG. 7*a;*
Figure 8A:
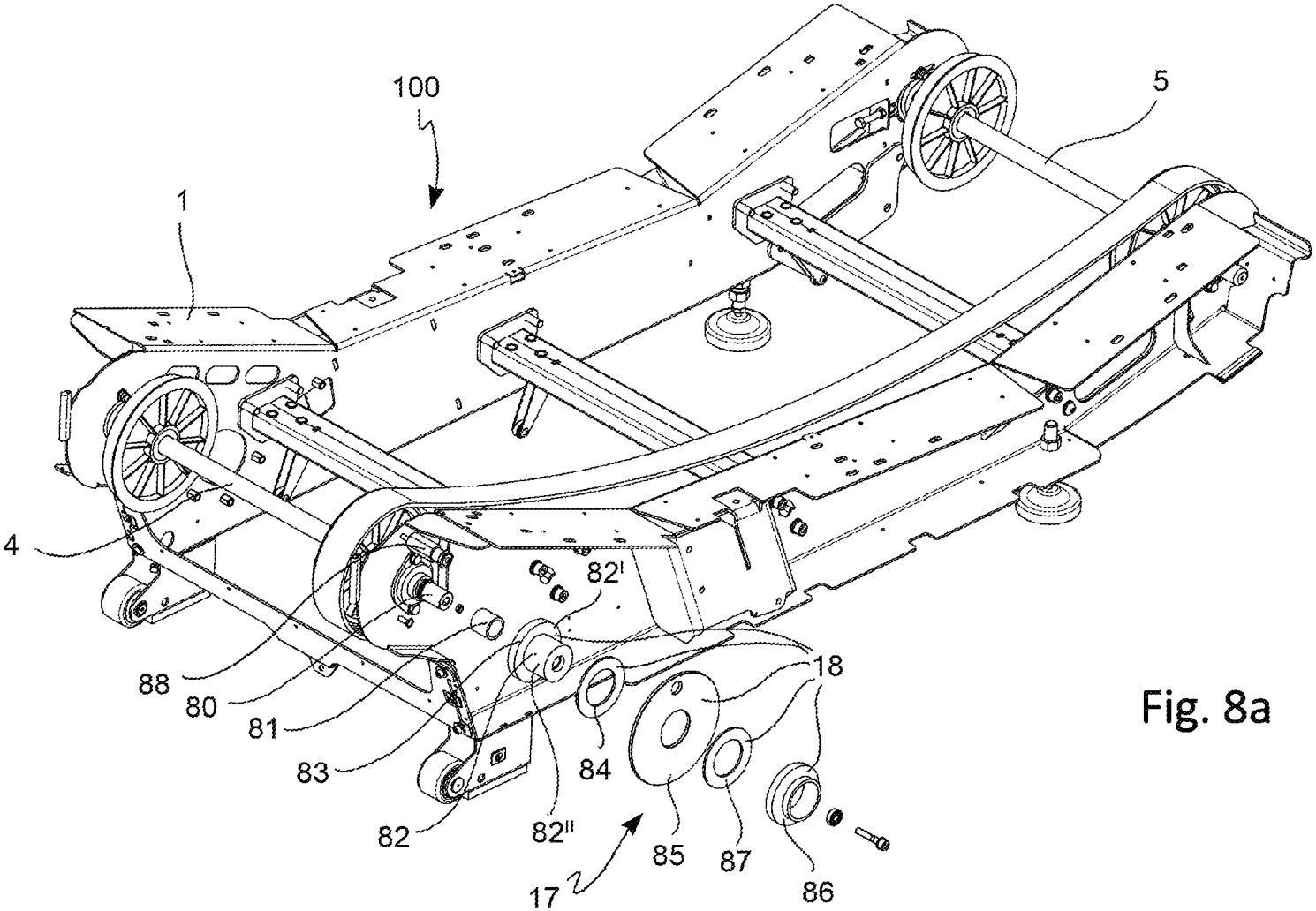
FIG. 8*a* shows a perspective view of a portion with an exploded part of the curved manual treadmill according to an embodiment of the invention.
Figure 8B:
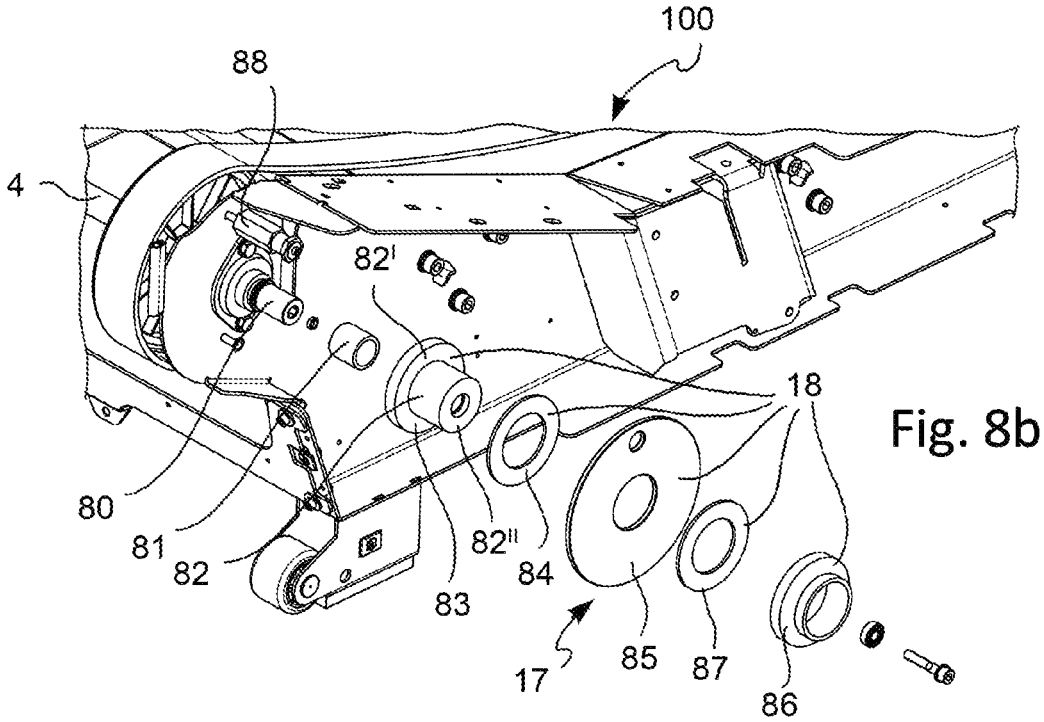
FIG. 8*b* shows an enlarged view of the exploded part of FIG. 8*a;*
Figure 8C:
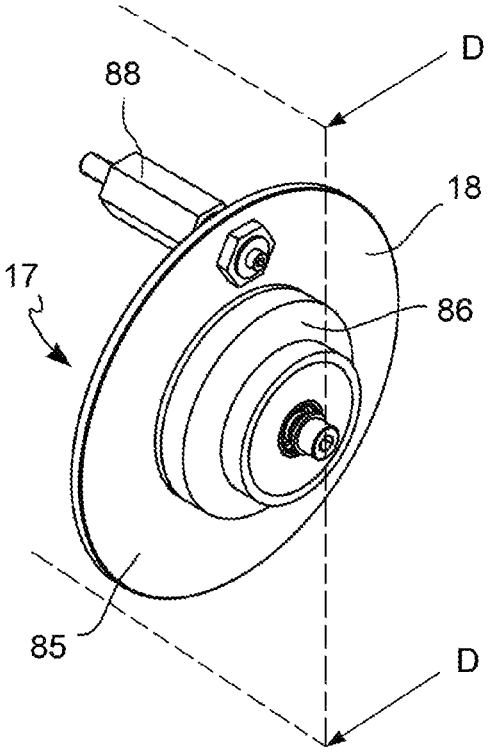
FIG. 8*c* shows a perspective view of a component of the curved treadmill of FIGS. 8*a* and 8*b*.
Figure 8D:
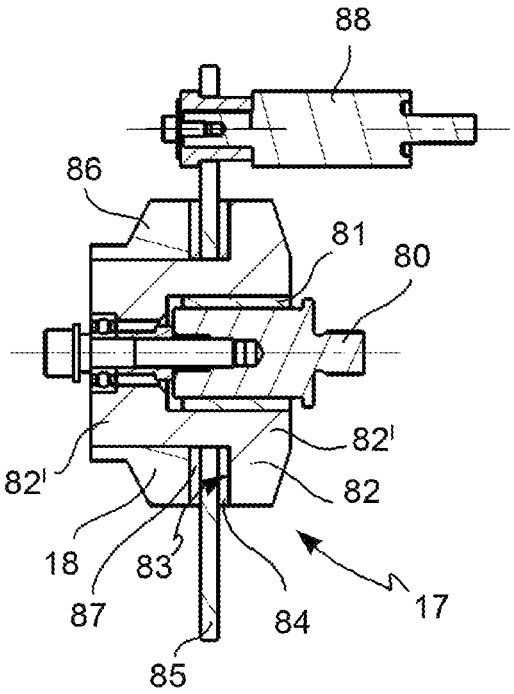
FIG. 8*d* shows a section view taken along plane DD of FIG. 8*c*.

Turning now to FIGS. 7*a* and 7*b*, according to a further embodiment, which is alternative to those described above, the resistance device 17 comprises a damping element 18 operatively connected to either the first rotation shaft 4 or the second rotation shaft.

In the embodiment shown in FIGS. 7*a* and 7*b*, the damping element 18 is operatively connected to the first rotation shaft 4.

It is worth noting that, also in this embodiment, the resistance device 17 is arranged on the same rotation axis as the rotation shaft on which to generate the resistance, i.e. the first rotation shaft 4.

In this embodiment, the resistance device 17 comprises a respective coupling device 70 operatively connected to the first rotation shaft 4 (or the second rotation shaft 5).

The coupling device 70 is, for example, a free-wheel type mechanism.

The inner surface (not seen in the figures) of the coupling device 70 is operatively coupled, by means of a plurality of rolls with which this type of mechanism is equipped, to the first rotation shaft 4 (or the second rotation shaft 5).

The resistance device 17 further comprises a bushing element 71 integral with the outer surface of the coupling device 70, e.g. by means of tight fit coupling.

The bushing element 71 is provided with a respective rotation shaft 71' on which the damping element 18 is mounted.

The damping element 18 comprises an inner part (not seen in the figures) and an outer part that are coaxial to each other, inside which the inner part is housed.

The inner part and the outer part of the damping element 18 are axially coupled to each other and free to rotate reciprocally.

The outer part is disc-shaped, for example, while the inner part is preferably ring-shaped.

The space between the inner part and the outer part of the damping element 18 is adapted to house a viscous fluid, suitable for generating a viscous resistance between the outer part and the inner part of the damping element 18 during the mutual rotation thereof.

The outer part is fixed to the frame 1 of the treadmill 100 by means of a respective bracket 72 on which the outer part of the damping element 18 is fixed (e.g. by means of screw). The bracket 72 is fixed, in turn, to the frame 1, e.g. by means of screws and spacers 73.

Also in this case, the outer part of the damping element 18 is the fixed part of the damping element 18.

The inner part is adapted to rotate within the outer part about a respective rotation axis and represents the mobile part of the damping element.

The inner part of the damping element 18 is operatively connected to the rotation shaft 71' of the bushing element 71, e.g. by shape coupling.

It is worth noting that in the embodiment in FIGS. 7*a* and 7*b*, the resistance device 17 comprises a further damping element 74 operatively arranged coaxially in series to the damping element 18.

The inner part of the further damping element 17 is operatively connected to the rotation shaft 71' of the bushing element 71, while the outer part of the further damping device 74 is fixed to the frame 1 by means of the bracket 72.

The damping element 18 is interposed between the further damping element 74 and the bracket 72.

The presence of the further damping element 74 allows to improve and increase the viscous resistance provided by the resistance device 17.

According to an embodiment, the coupling device 70 is adapted to make either the first rotation shaft 4 or the second rotation shaft 5 (the first rotation shaft 4, in the example shown in the figures) and the bushing element 71 freely rotatable when the first rotation shaft 4 of the frame 1 rotates to move the upper portion P1 of the physical exercise surface 6 along the first advancing direction from the first rotation shaft 4 to the second rotation shaft 5 and to make either the first rotation shaft 4 or the second rotation shaft 5 and the bushing element 71 integral when the first rotation shaft 4 of the frame 1 rotates in the opposite direction to move the upper portion P1 of the physical exercise surface 6 along the second advancing direction from the second rotation shaft 5 to the first rotation shaft 4.

Indeed, it is worth noting that the rotation of the bushing element 71, and thus of the respective rotation shaft 71' results, in turn, in the rotation of the inner (mobile) part of the damping element 18 (and of the further damping element 74) with respect to its outer part, resulting in the generation of a viscous resistance on the first rotation shaft 4 (or on the second rotation shaft 5) along the second advancing direction of the upper portion of the closed physical exercise path P1 of the physical exercise surface 6.

According to a further embodiment, either alternatively to or in combination with the one above, the coupling device 70 of the resistance device 17 could be configured to allow the action of the damping element 18 also in the first advancing direction of the physical exercise surface 6.

Turning now to FIGS. 8*a*-8*d*, according to a further embodiment, which is alternative to those described above, the resistance device 17 comprises a brake device 18 operatively connected to either the first rotation shaft 4 or the second rotation shaft 5.

In the embodiment in FIGS. 8*a*-8*d*, the damping element 18 is operatively connected to the first rotation shaft 4.

It is worth noting that, also in this embodiment, the resistance device 17 is arranged on the same rotation axis as the rotation shaft on which to generate the resistance, i.e. the first rotation shaft 4.

In this embodiment, the resistance device 17 comprises a first fixing element 80 to either the first rotation shaft 4 or the second rotation shaft 5 (the first rotation shaft 4, in the example shown in the figures), e.g. a pin, operatively fixed to either the first rotation shaft 4 or the second rotation shaft (the second rotation shaft 5, in the example shown in the figures), e.g. by tight fit or shape coupling.

The resistance device 17 further comprises a coupling device 81 operatively connected to the first fixing element 80.

The coupling device 81 is, for example, a free-wheel type mechanism.

The inner surface (not seen in the figures) of the coupling device 81 is operatively coupled, by means of a plurality of rolls with which this type of mechanism is equipped, to the first fixing element 80.

The damping element 18 further comprises a bushing element 82 integral with the outer surface of the coupling device 81, e.g. by tight fit coupling.

The first bushing element 82 comprises a first base portion 82' and a second portion 82" extending from the first base portion 82'.

The radial dimension of the first base portion 82' is greater than the second portion 82" so as to define an abutment surface 83.

The damping element 18 further comprises at least one first ring 84 made of friction material (e.g. a brake lining) fixed to the first bushing element 82 abutting on the abutting surface 83.

The damping element 18 further comprises an auxiliary friction ring 85, e.g. made of a metal material, operatively associated with the first bushing element 82 so as to abut against said at least one first ring 84 made of friction material.

The damping element 18 further comprises a second bushing element 86 operatively fixed to the first bushing element 82, e.g. by tight fit or shape coupling, so as to abut against the auxiliary fiction ring 85.

The damping element 18 further comprises at least one second ring 87 made of friction material (e.g. a brake lining) fixed to the second bushing element 86.

The second ring 87 made of friction material is interposed between the second bushing element 86 and the auxiliary friction ring 85.

It is worth noting that the distance between the second bushing element 86 and the first bushing element 82 is axially adjustable.

Advantageously, such an adjustment allows the abutment of the first ring 84 made of friction material, the auxiliary friction ring 85 and the second ring 87 made of friction material and the adjustment of the contact pressure between the first ring 84 made of friction material, the auxiliary friction ring 85 and the second ring 87 made of friction material, thereby to adjust the resistant friction or damping force ensured by the damping element 18 of the resistance device 17.

The resistance device 17 further comprises a second fixing element 88 to the frame 1 of the treadmill 100 fixed to the frame 1. The second fixing element 88 is, for example, a pin.

The auxiliary friction ring 85 is fixed to the frame 1 of the treadmill 100 by means of the second fixing element 88 to the frame 1.

It is worth noting that the first bushing element 82 provided with the first ring 84 made of friction material and the second bushing element 86 provided with the second ring 87 made of friction material coupled to each other and the auxiliary friction ring 85 are axially coupled to one another and free to rotate reciprocally about the rotation axis of either the first rotation shaft 4 or the second rotation shaft (the rotation shaft of the first rotation shaft A4, in the example in the figures).

The rotation of the first bushing element 82 and of the second bushing element 86 with respect to the auxiliary friction ring 85 is adapted to generate a friction during the reciprocal rotation of the first bushing element 82 and of the second bushing element 86 with respect to the auxiliary friction ring 85.

According to an embodiment, the coupling device 81 is adapted to make either the first rotation shaft 4 or the second rotation shaft 5 (the first rotation shaft 4, in the example shown in the figures) and the first bushing element 82 of the resistance device 17 freely rotatable when the first rotation shaft 4 of the frame 1 rotates to move the upper portion P1 of the physical exercise surface 6 along the first advancing direction from the first rotation shaft 4 to the second rotation shaft 5 and to make either the first rotation shaft 4 or the second rotation shaft 5 and the first bushing element 82 integral when the first rotation shaft 4 of the frame 1 rotates in the opposite direction to move the upper portion P1 of the physical exercise surface 6 along the second advancing direction from the second rotation shaft 5 to the first rotation shaft 4.

The rotation of the first bushing element 82 results in the rotation of the second bushing element 86, thus the rotation of the first ring 84 made of friction material and of the second ring 87 made of friction material against the auxiliary friction ring 85 resulting in the generation of friction on the first rotation shaft 4 (or on the second rotation shaft 5) along the second advancing direction of the upper portion of the closed physical exercise path P1 of the physical exercise surface 6.

According to a further embodiment, either alternatively to or in combination with the one above, the coupling device 81 of the resistance device 17 could be configured to allow the action of the damping element 18 also in the first advancing direction of the physical exercise surface 6.

An example of operation of the treadmill 100 will now be described with reference to the embodiment shown in FIGS. 7*a* and 7*b*.

The user climbs onto the physical exercise surface 6 to perform various physical exercises on the physical exercise surface 6, which is adapted to rotate about the first rotation shaft 4 and the second rotation shaft 5.

When the user moves the physical exercise surface 6 along the first advancing direction from the first rotation shaft 4 to the second rotation shaft 5, the coupling device 70 of the resistance device 17 does not act, thus leaving the first rotation shaft 4 and the bushing element 71 of the resistance device 17 freely rotatable with respect to each other. In this manner, any action by the damping element 18 (and by the further damping element 74, if present) is prevented.

In this manner, the user can perform physical exercises without any braking action, e.g. simply running or walking.

Instead, when the user moves the physical exercise surface 6 along the second advancing direction from the second rotation shaft 5 to the first rotation shaft 4 opposite to the first advancing direction, the coupling device 71 of the resistance device 17 acts, thus making the first rotation shaft 4 and the bushing element 71 of the resistance device 17 mutually integral. In this manner, the action of the damping element 18 is allowed which generates the viscous resistance on the first rotation shaft 4 (or on the second rotation shaft 5).

In this manner, the user can perform physical exercises under a braking action of the physical exercise surface 6, which physical exercises are different from those which can be performed when the physical exercise surface 6 is not subject to any braking action.

Such physical exercises may be of the muscle-strengthening type, also when the user holds the support portion 3 of the frame 1 (towing or pushing exercises).

As apparent, the object of the invention is fully achieved because the curved treadmill described above has many advantages, as previously mentioned.

Firstly, the curved treadmill is certainly alternative to the ones described with reference to the prior art.

Furthermore, the presence of the resistance device 17, according to any one of the embodiments described, allows to generate a braking action (resistance, friction) on the physical exercise surface 6 only in the advancing direction of the physical exercise surface 6, thus allowing the user to change the type of physical exercises to be performed on the treadmill 100 simply by inverting the advancing direction of the physical exercise surface 6.

A person skilled in art may make changes and adaptations to the embodiments of the curved manual treadmill described above or can replace elements with others which are functionally equivalent to satisfy contingent needs without departing from the scope of protection of the appended claims. Each of the features described as belonging to a possible embodiment can be achieved independently from the other embodiments described.

The invention claimed is:

1. A curved manual treadmill for the physical exercise of a user, comprising:

a frame extending along a longitudinal direction;

a first rotation shaft adapted to rotate around a respective first rotation axis transversal to the longitudinal direction of the frame;

a second rotation shaft adapted to rotate around a respective second rotation axis transversal to the longitudinal direction of the frame; and a physical exercise surface operatively connected to the first rotation shaft and to the second rotation shaft, so as to generate an endless closed physical exercise path, the physical exercise path having a set curved lateral profile along the longitudinal direction of the frame so that a force generated by the user on the physical exercise surface generates the rotation of the first rotation shaft and of the second rotation shaft causing the movement of the upper portion of the physical exercise surface along a first advancing direction from the first rotation shaft to the second rotation shaft or along a second advancing direction from the second rotation shaft to the first rotation shaft, the physical exercise surface comprising a resistance device for resisting the movement of the upper portion of the physical exercise surface operatively associated with one of the first rotation shaft and the second rotation shaft, the resistance device being configured to oppose the rotation of said one of the first rotation shaft and the second rotation shaft in the second advancing direction of the physical exercise surface and to not oppose the rotation of said one of the first rotation shaft and the second rotation shaft in the first advancing direction of the physical exercise surface, wherein the resistance device comprises:

a damping element operatively connected to one of the first rotation shaft and the second rotation shaft;

a first fixing element operatively fixed to said one of the first rotation shaft and the second rotation shaft;

a coupling device operatively connected to the first fixing element; and a second fixing element fixed to the frame of the treadmill, the damping element being further fixed to the frame of the treadmill through the second fixing element.

2. The treadmill according to claim 1, wherein the resistance device comprises a damping element operatively connected to one of the first rotation shaft and the second rotation shaft through a respective belt-pulley mechanism with which the treadmill is equipped, the belt-pulley mechanism comprising a first pulley, a second pulley and a motion transmission belt operatively connected to the first pulley and to the second pulley, the first pulley being integral with one of the first rotation shaft and the second rotation shaft of the treadmill, the second pulley being coupled with the frame of the treadmill through a first bracket fixed to the frame, the second pulley being freely rotatable about a respective rotation axis.

3. The treadmill according to claim 2, wherein the damping element comprises an inner part and an outer part that are coaxial to one another, inside which the inner part is housed, the space between the inner part and the outer part of the damping element being adapted for housing a viscous fluid, suitable for generating a viscous resistance between the outer part and the inner part of the damping element during the mutual rotation thereof, the outer part being fixed to the frame of the treadmill and representing the fixed part of the damping element, the inner part being adapted to rotate inside the outer part about a respective rotation axis and representing the mobile part of the damping element, the inner part of the damping element being operatively connected to the second pulley through a second bracket fixed to the second pulley, the second bracket comprising a respective rotation shaft integral with the second pulley with which the inner part of the damping element is in turn integral so that the rotation of the second pulley results in the generation, by the damping element, of a viscous resistance that opposes the rotation of the second pulley.

4. The treadmill according to claim 3, wherein the resistance device also comprises a respective coupling device operatively associated with the first pulley, the coupling device being adapted for making the first pulley and one of the first rotation shaft and the second rotation shaft freely rotatable when the first rotation shaft of the frame rotates to move the upper portion of the physical exercise surface along the first advancing direction from the first rotation shaft to the second rotation shaft and for making the first pulley and at least one of the first rotation shaft and the second rotation shaft integral when the first rotation shaft of the frame rotates in the opposite direction to move the upper portion of the physical exercise surface along the second advancing direction from the second rotation shaft to the first rotation shaft.

5. The treadmill according to claim 1, wherein the resistance device comprises a damping element mounted on a rotation shaft on which a brake disc of a brake device with which the treadmill is equipped is mounted.

6. The treadmill according to claim 5, wherein the damping element comprises an inner ring and an outer ring that are coaxial to each other, inside which the inner ring is housed, the space between the inner ring and the outer ring of the damping element being adapted for housing a viscous fluid, suitable for generating a viscous resistance between the outer ring and the inner ring of the damping element during the mutual rotation thereof, the outer ring being fixed to the frame of the treadmill and representing the fixed part of the damping element, the inner ring being adapted for rotating inside the outer ring about a respective rotation axis and representing the mobile part of the damping element, the inner ring of the damping element being operatively connected to the rotation shaft on which the brake disc of the brake device is mounted through a coupling device with which the brake device adapted for connecting the brake disc to the respective rotation shaft is equipped.

7. The treadmill according to claim 6, wherein the coupling device is adapted for making the rotation shaft on which the brake disc is mounted and the inner ring of the damping element freely rotatable when the first rotation shaft of the frame rotates to move the upper portion of the physical exercise surface along the first advancing direction from the first rotation shaft to the second rotation shaft and for making the rotation shaft on which the brake disc is mounted and the inner ring of the damping element integral when the first rotation shaft of the frame rotates in the opposite direction to move the upper portion of the physical exercise surface along the second advancing direction from the second rotation shaft to the first rotation shaft.

8. The treadmill according to claim 1, wherein the resistance device comprises a damping element operatively connected to one of the first rotation shaft and the second rotation shaft, the resistance device comprising a respective coupling device operatively connected to one of the first rotation shaft and the second rotation shaft.

9. The treadmill according to claim 8, wherein the resistance device also comprises a bushing element integral with the outer surface of the coupling device, the bushing element being equipped with a respective rotation shaft on which the damping element is mounted, the damping element comprising an inner part and an outer part that are coaxial to each other, inside which the inner part is housed, the space between the inner part and the outer part of the damping element being adapted for housing a viscous fluid suitable for generating a viscous resistance between the outer part and the inner part of the damping element during the mutual rotation thereof, the outer part being fixed to the frame of the treadmill through a respective bracket on which the outer part of the damping element is fixed, the bracket being in turn fixed to the frame, the outer part of the damping element representing the fixed part of the damping element, the inner part being adapted for rotating inside the outer part about a respective rotation axis and representing the mobile part of the damping element, the inner part of the damping element being operatively connected to the rotation shaft of the bushing element through the same bracket that allows the outer part of the damping element to be fixed to the frame.

10. The treadmill according to claim 9, wherein the coupling device is adapted for making one of the first rotation shaft and the second rotation shaft and the bushing element freely rotatable when the first rotation shaft of the frame rotates to move the upper portion of the physical exercise surface along the first advancing direction from the first rotation shaft to the second rotation shaft and for making said at least one of the first rotation shaft and the second rotation shaft and the bushing element integral when the first rotation shaft of the frame rotates in the opposite direction to move the upper portion of the physical exercise surface along the second advancing direction from the second rotation shaft to the first rotation shaft.

11. The treadmill according to claim 1, wherein the damping element comprises:

a first bushing element integral with the outer surface of the coupling device, the first bushing element comprising a first base portion and a second portion extending from the first base portion, the first base portion having a larger radial dimension with respect to the second portion so as to define an abutment surface;

at least one first ring of friction material fixed to the first bushing element in abutment with the abutment surface;

an auxiliary friction ring operatively associated with the first bushing element so that the auxiliary friction ring is in abutment with said at least one first ring of friction material;

a second bushing element operatively fixed to the first bushing element, so as to go into abutment with the auxiliary friction ring;

a second ring of friction material fixed to the second bushing element, the second ring being made of friction material and being arranged between the second bushing element and the auxiliary friction ring, the auxiliary friction ring being fixed to the frame of the treadmill through the second fixing element.

12. The treadmill according to claim 11, wherein the coupling device is adapted:

for making one of the first rotation shaft and the second rotation shaft and the first bushing element of the resistance device freely rotatable when the first rotation shaft of the frame rotates to move the upper portion of the physical exercise surface along the first advancing direction from the first rotation shaft to the second rotation shaft, and for making one of the first rotation shaft and the second rotation shaft and the first bushing element integral, when the first rotation shaft of the frame rotates in the opposite direction to move the upper portion of the physical exercise surface along the second advancing direction from the second rotation shaft to the first rotation shaft.

* * * * *